US006669287B1

(12) United States Patent
DeLilla

(10) Patent No.: US 6,669,287 B1
(45) Date of Patent: Dec. 30, 2003

(54) WHEELCHAIR TRANSFER DEVICE

(75) Inventor: Thomas DeLilla, Tallahassee, FL (US)

(73) Assignee: Enabling Technologies of North Florida, Inc., Tallahassee, FL (US)

( * ) Notice: Subject to any disclaimer, the term of this patent is extended or adjusted under 35 U.S.C. 154(b) by 0 days.

(21) Appl. No.: 10/285,782

(22) Filed: Nov. 2, 2002

(51) Int. Cl.[7] ..... A61G 7/14

(52) U.S. Cl. ..... 297/243; 297/423.4; 297/463.2; 297/DIG. 4; 280/304.1; 5/81.1 R

(58) Field of Search ..... 297/5, 6, 423.11, 297/423.12, 243, DIG. 4, 463.2, 423.4; 5/81.1 R; 280/304.1

(56) References Cited

U.S. PATENT DOCUMENTS

| | | | | | |
|---|---|---|---|---|---|
| 2,872,967 | A | * | 2/1959 | Kirkpatrick | 297/5 |
| 3,405,954 | A | * | 10/1968 | Wolfe | 297/5 |
| 3,584,890 | A | * | 6/1971 | Presty | 297/DIG. 4 |
| 3,993,349 | A | | 11/1976 | Neufeld et al. | |
| 3,999,778 | A | | 12/1976 | Markiel | |
| 4,046,348 | A | | 9/1977 | Goodwin | |
| 4,278,387 | A | | 7/1981 | Seguela et al. | |
| 4,288,124 | A | | 9/1981 | Hamilton | |
| 4,314,576 | A | * | 2/1982 | McGee | 297/6 |
| 4,365,924 | A | | 12/1982 | Brigman et al. | |
| 4,547,015 | A | | 10/1985 | Wakimoto | |
| 4,737,997 | A | | 4/1988 | Lawson | |
| 4,948,156 | A | * | 8/1990 | Fortner | 297/DIG. 4 |
| 5,054,849 | A | | 10/1991 | Hoff | |
| 5,277,438 | A | * | 1/1994 | Chuang | 297/5 |
| 5,507,548 | A | | 4/1996 | Marhefka | |
| 5,596,775 | A | | 1/1997 | DiMatteo et al. | |
| 5,709,428 | A | | 1/1998 | Hugghins | |
| 6,135,557 | A | | 10/2000 | Gustafsson | |
| 6,224,153 | B1 | | 5/2001 | Vodinh | |
| 6,571,915 | B1 | * | 6/2003 | de la Tour | 297/DIG. 10 |

* cited by examiner

*Primary Examiner*—Peter R. Brown
(74) *Attorney, Agent, or Firm*—William H. Hollimon

(57) ABSTRACT

A wheelchair transfer device which includes a seat intermediate between the wheelchair seat and the floor, a pair of seat supports suitable for attachment to the wheelchair and for supporting the seat, and hand supports integral to the frame whereby a wheelchair user, using only the user's own motive power, may easily self-transfer from the wheelchair to the intermediate seat and from the intermediate seat to the floor and vice versa.

10 Claims, 5 Drawing Sheets

WHEELCHAIR TRANSFER DEVICE

BACKGROUND

1. Field of Invention

This invention generally relates to a wheelchair transfer apparatus. More particularly, the present invention allows the user of a wheelchair to self-transfer from a wheelchair to the floor and from the floor into a wheelchair.

2. Background

There are a great number of persons who, for a multitude of reasons, must rely upon wheelchairs for independent mobility. For example, many people have sustained spinal cord injuries that have left these people without the use of their legs. Others have sustained injuries or have other disabilities that limit the use of their legs. Nonetheless, these individuals often retain use of their upper bodies and are capable and desirous of all manner of activities and interactions. Many of these activities, such as sitting on the floor to exercise or to play with children, accessing a swimming pool, or gardening, require the wheelchair user to transfer from the wheelchair to the floor and from the floor back into the wheelchair. These activities often occur in a multitude of locations and are often spontaneously encountered. Additionally, in the event of an accident where the wheelchair user is separated from the wheelchair, the safety and security of the wheelchair user often requires the user to be able to re-access the wheelchair. However, it is often problematical for such persons to safely and efficiently transfer from the wheelchair to the floor and back into the wheelchair without the assistance of another individual or the assistance of some fixed transfer apparatus.

In response to the aforementioned problems, various devices are known for assisting a person's movement to and from a wheelchair. Information relevant to attempts to address these problems can be found in U.S. Pat. Nos. 2,596,055, 3,993,349, 3,999,778, 4,046,348, 4,278,387, 4,288,124, 4,365,924, 4,547,015, 4,737,997, 5,054,849, 5,507,548, 5,522,642, 5,596,775, 5,709,428, 6,135,557, and 6,224,153.

However, each one of these references suffers from one or more of the following disadvantages:

1. the apparatus facilitates transfer only to a standing position;
2. the apparatus facilitates transfer to or from a bed;
3. the apparatus is heavy and not easily portable;
4. the apparatus restricts normal function of the wheelchair;
5. the apparatus is not easily and readily adaptable to various wheelchair designs;
6. the apparatus is complex, expensive, and difficult to manufacture; and
7. the apparatus requires the assistance of an attendant.

For the foregoing reasons, there is a need for a wheelchair transfer device that is of simple design and construction, that is inexpensive to manufacture, that is readily and easily adaptable to a variety of wheelchair designs, that facilitates transfer of a wheelchair user from the wheelchair to the floor and from the floor into the wheelchair, that is light and easily portable, that does not restrict normal operation of the wheelchair, and that allows a wheel chair user to self-transfer, using only the user's own motive power, from the wheelchair to the floor and back into the wheelchair.

SUMMARY

The present invention is directed to a wheelchair transfer device that satisfies this need. According to the present invention, the wheelchair transfer device includes a pair of seat supports, each seat support including a first vertical member adapted to be connected to the wheelchair and to contact the floor, a second vertical member of lesser length than the first vertical member, with the second vertical member disposed in front of the first vertical member and in contact with the floor, a horizontal member disposed between the first and second vertical members, and a transition member that is substantially co-planar with the horizontal member and is disposed between the top of the first vertical member and the top of the second vertical member, with the transition member further extending in a cantilevered fashion horizontally from the second vertical member, an intermediate seat comprising a flexible sling extending between the pair of seat supports and adapted to be connected to each horizontal member of each seat support, and means for attaching the seat supports to the wheelchair.

Accordingly, several objects and advantages of the present invention are:

1. to be of simple design and construction;
2. to be inexpensive and easy to manufacture;
3. to be light and easily portable;
4. to not restrict normal operation of the wheelchair;
5. to be readily and easily adaptable to various wheelchair designs;
6. to facilitate transfer of a wheelchair user from the wheelchair to the floor and from the floor to the wheelchair; and
7. to allow a wheelchair user to self-transfer, under only the user's motive power, from the wheelchair to the floor and from the floor to the wheelchair.

DRAWINGS

These and other features, aspects, and advantages of the present invention will become better understood with regard to the following description, appended claims, and accompanying drawings wherein:

The below table summarizes the reference numbers and associated elements shown in the above drawings:

| | |
|---|---|
| 104 | wheelchair |
| 105 | wheelchair seat |
| 106 | floor |
| 107 | wheelchair rear wheel |
| 108 | wheelchair front wheel |
| 200 | seat support |
| 201 | first vertical member |
| 202 | second vertical member |
| 203 | horizontal member |
| 204 | transition member |
| 204a | first horizontal portion |
| 204b | transition portion |
| 204c | second horizontal portion |
| 300 | bracket |

-continued

| | |
|---|---|
| 301 | first attaching portion |
| 302 | second attaching portion |
| 303 | guide tube |
| 400 | wheelchair transfer device |
| 401 | intermediate seat |
| 501 | transverse sleeve |

DESCRIPTION

Figure 1:
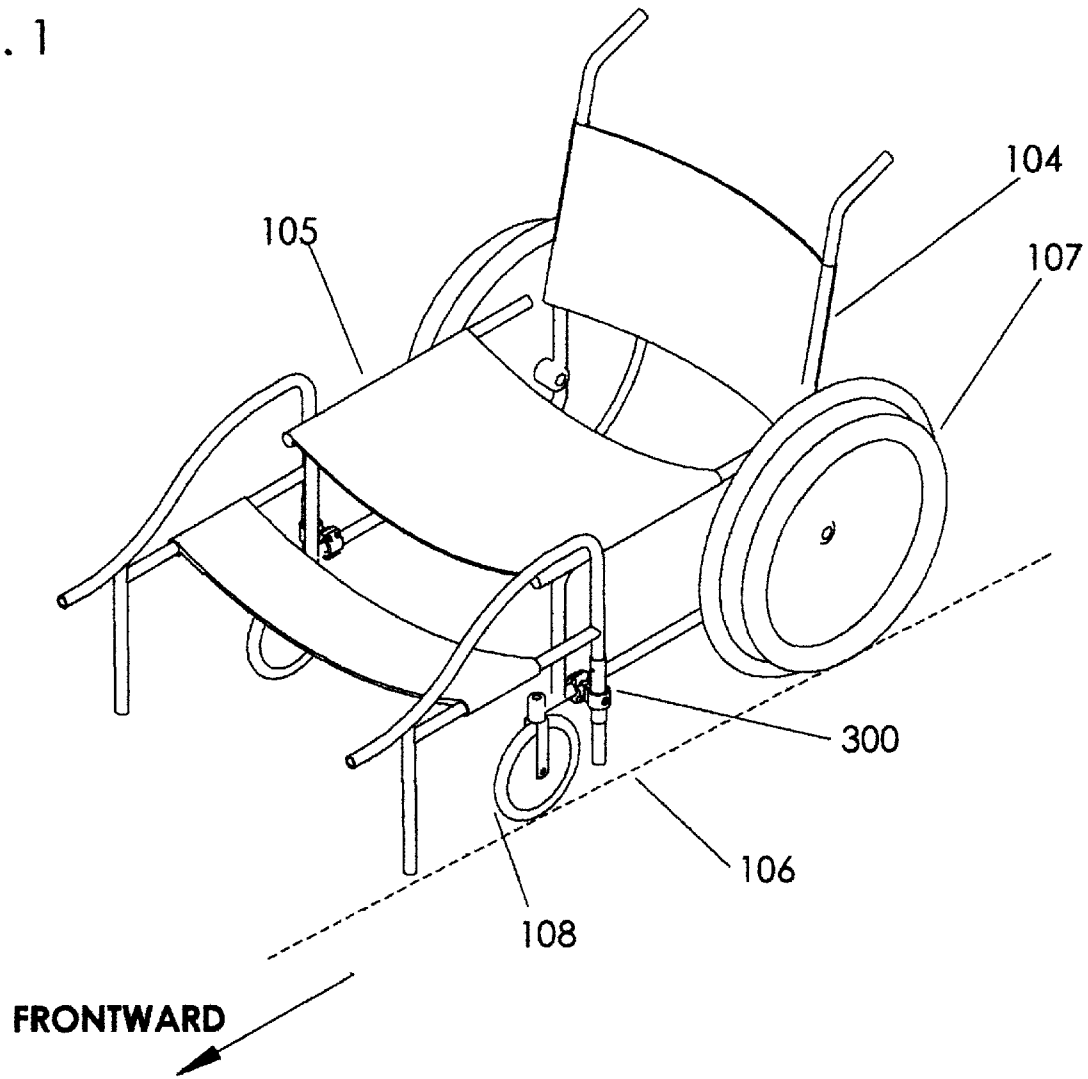
FIG. 1 is an isometric view of the present invention attached to a conventional wheelchair.
Figure 2:
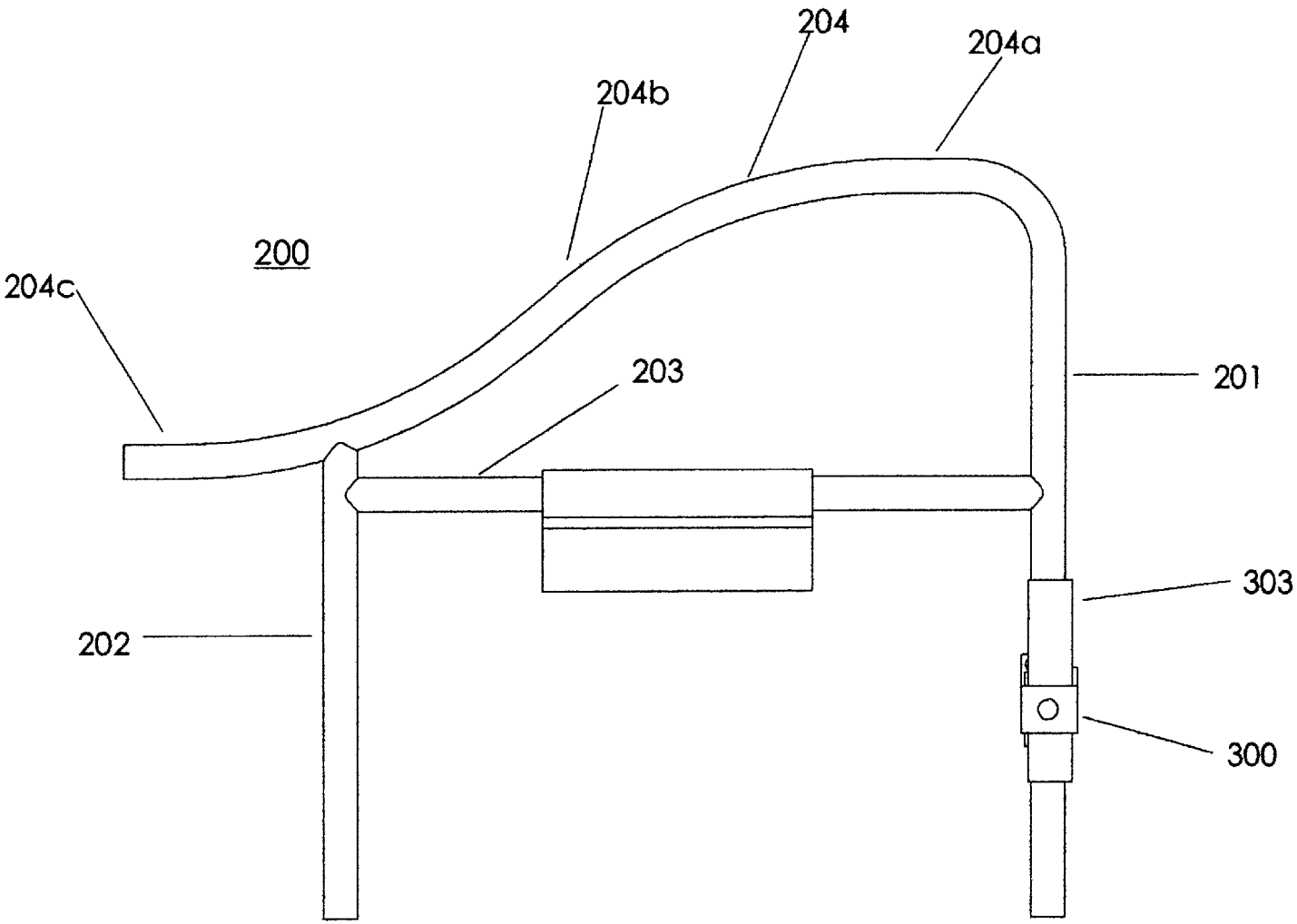
FIG. 2 is a side view of a seat support of the present invention.
Figure 3:
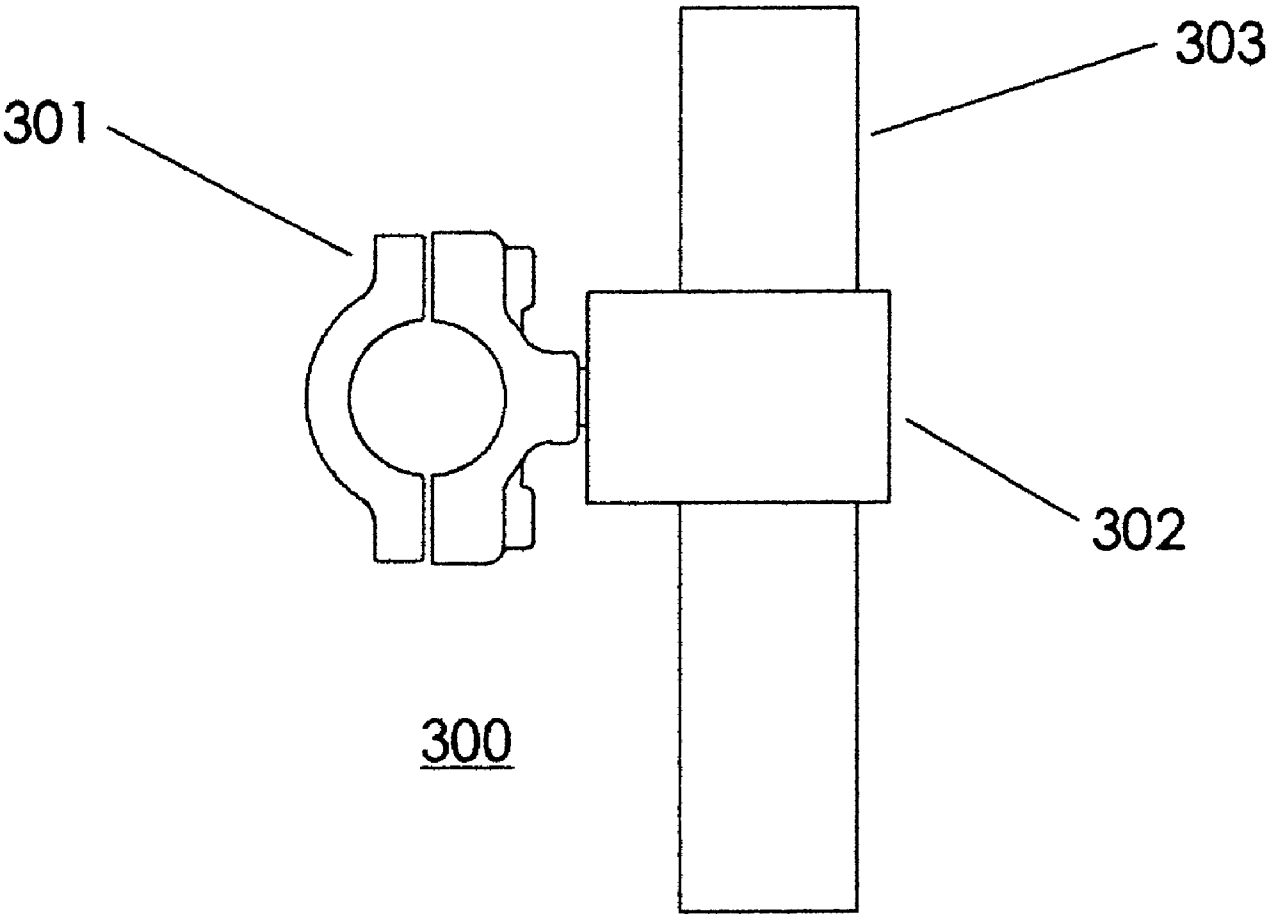
FIG. 3 is a side view of a connection bracket of the present invention.
Figure 4:
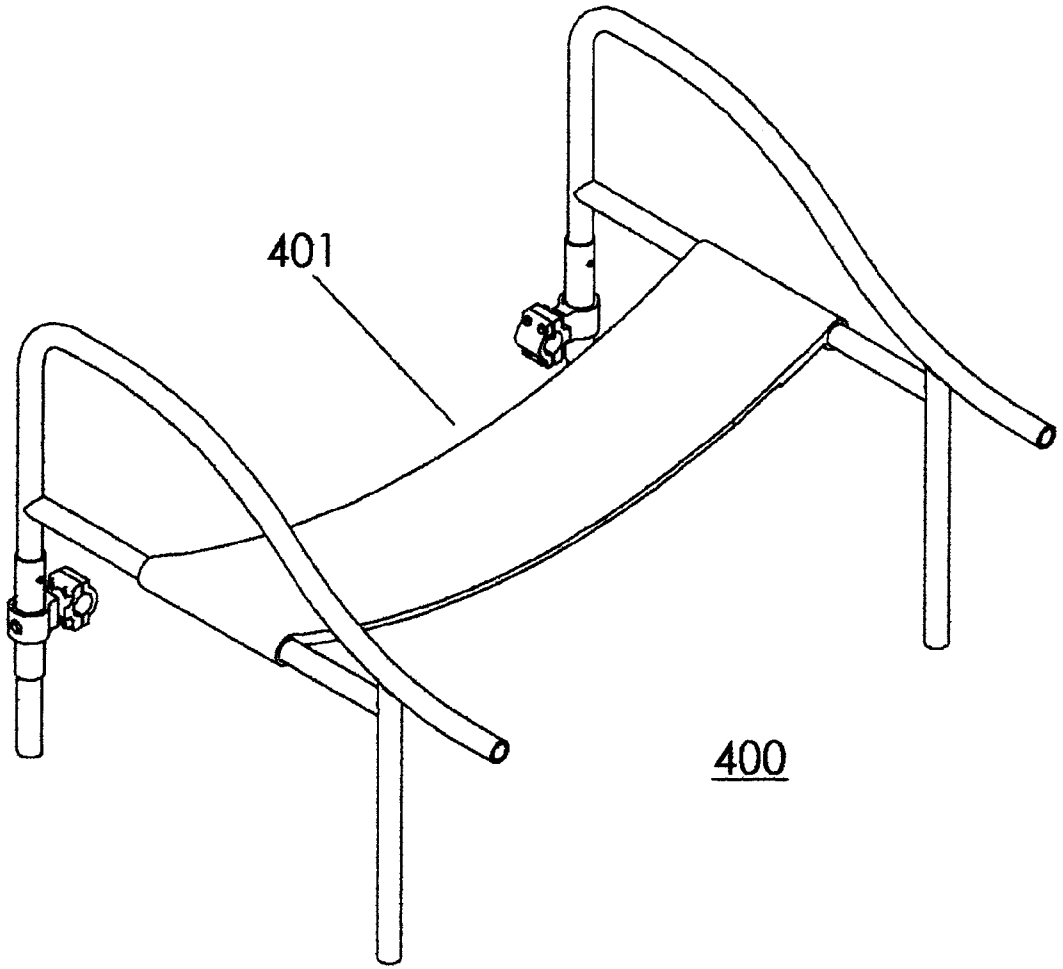
FIG. 4 is an isometric view of the present invention.
Figure 5:
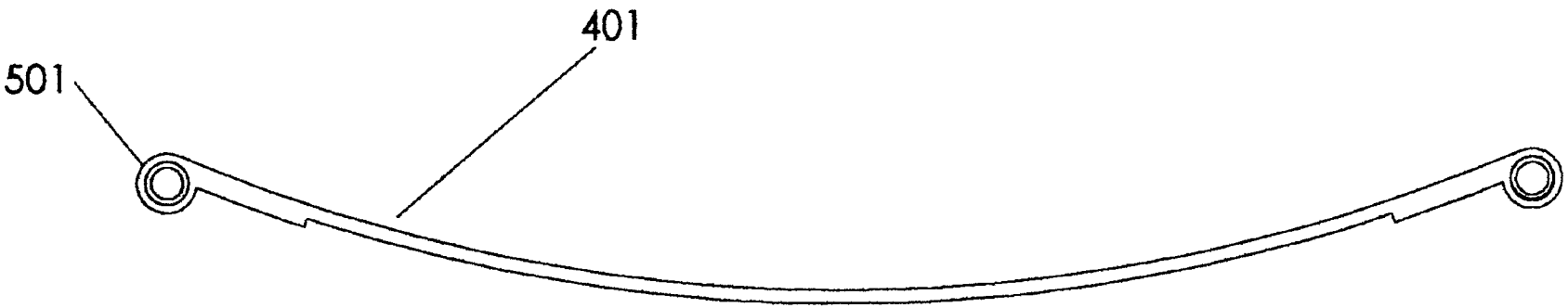
FIG. 5 is a front view of the intermediate seat of the present invention.

An embodiment of the wheelchair transfer device 400 of the present invention is shown in FIG. 4, and an embodiment of the present invention attached to a conventional wheelchair 104 is shown in FIG. 1. FIG. 2 shows a side view of one of a pair of seat supports 200, and FIG. 3 shows a side view of one of a pair of brackets 300.

As shown in FIG. 1, wheelchair transfer device 400 is attached to wheelchair 104 on each side of the wheelchair 104, at a position intermediate to wheelchair front wheel 108 and wheelchair rear wheel 107. In the embodiment shown, a pair of brackets 300 is used to connect a pair of seat supports 200 to the wheelchair 104. As can be seen in FIG. 2, the seat support 200 is comprised of a first vertical member 201, a second vertical member 202, a horizontal member 203, and a transition member 204. The transition member 204 further includes a first horizontal portion 204*a*, a transition section 204*b*, and a second horizontal section 204*c*.

Seat support 200 is constructed from any suitable material that is light, rigid, and strong. For example, tubing similar to that used in the construction of bicycles, such as aluminum, steel, alloys, carbon fiber, and titanium, or other materials such as plastics and wood that are sufficiently light, rigid, and strong may be used. First vertical member 201, second vertical member 202, horizontal member 203, and transition member 204 are connected together by appropriate fastening means which may include threaded fasteners such as nuts and bolts, hook and pile fasteners, adhesives and epoxies, hooks, magnets, rivets, soldering, welding, surface tension, and nailing. It is also possible to form the components of seat support 200 by bending and connecting (as described above) continuous lengths of bendable tubing. For example, first vertical member 201 and transition member 204 may be formed from a continuous length of material by bending and second vertical member 202 and horizontal member 203 may be formed from a continuous length of material by bending. First vertical member 201 and second vertical member 202 may also be of adjustable length to accommodate different wheelchair seat heights and uneven floor or ground surfaces. These examples are intended to be representative of possible construction methods and are not exclusive to other methods that may be known to those skilled in the art.

As can be seen in FIG. 3, bracket 300 includes a first attaching portion 301 adapted to be connected to wheelchair 104, and a second attaching portion 302 adapted to be connected to first vertical member 201. First attaching portion 301 and second attaching portion 302 may either be fixedly or swivelably connected. First attaching portion 301 may be attached to wheelchair 104 by fastening means which may include clamps, threaded fasteners such as nuts and bolts, hook and pile fasteners, adhesives and epoxies, hooks, magnets, rivets, soldering, welding, surface tension, and nailing. In the embodiment shown, a guide tube 303 is positioned within second attaching portion 302. Guide tube 303 may be constructed of material similar to that used in the construction of seat support 200. Guide tube 303 is hollow with an interior cross section designed to slidingly receive and support first vertical support member 201. For example, guide tube 303 may be constructed of tubing with an inside diameter slightly larger than the exterior diameter of the tubing it receives. Alternatively, guide tube 303 may also include a longitudinal, exterior tab designed to be received by an indentation in the interior of second attaching portion 302.

As is shown in FIG. 4, intermediate seat 401 is a flexible sling type seat extending between each seat support 200. Intermediate seat 401 may be constructed of any material suitable to support the weight of the wheelchair user such as leather, canvas, plastic, or a material made from a synthetic fiber such as nylon. Intermediate seat 401 is adapted to be connected to each horizontal member 203 of each seat support 200 by, for example, forming a transverse sleeve at each end of intermediate seat 401 adapted to slidingly receive each horizontal member 203. Each transverse sleeve may either be permanently formed into intermediate seat 401 by sewing, gluing, or heat treating, or removably formed through the use of hook and loop fasteners or threaded fasteners such as nuts and bolts. These examples are intended to be representative of possible construction methods and are not exclusive to other methods that may be known to those skilled in the art.

OPERATION

Each bracket 300 is connected to wheelchair 104. Wheelchair transfer device 400 is connected to wheelchair 104 by positioning wheelchair transfer device 400 in front of wheelchair 104 and slidingly engaging each first vertical member 201 of each seat support 200 through each guide tube 303 of each bracket 300. Once wheelchair transfer device 400 is in place, to transfer from wheelchair 104 to the floor 106, a person reaches forward and slides intermediate seat 401 forward, away from wheelchair 104, along horizontal members 203. The person then lifts his/her feet and positions them over and forward of intermediate seat 401, then slides intermediate seat 401 rearward along horizontal members 203. The person then grasps first horizontal portion 204*a* of transition member 204. The person then presses down on first horizontal portion 204*a*, slides forward on wheelchair seat 105, and lowers himself or herself into intermediate seat 401. The person then moves his or her hands down each transition section 204*b* to grasp each second horizontal portion 204*c*. He or she then presses down on second horizontal portion 204*c*, slides forward on intermediate seat 401, and lowers himself or herself to floor 106.

To transfer from the floor 106 to the wheelchair 104, a person performs the reverse operation. The person positions himself or herself on the floor 106 in front of wheelchair transfer device 400. He or she then reaches back, grasps second horizontal portion 204*c*, and lifts and slides his or her body onto intermediate seat 401. From this intermediate position, he or she reaches back, grasps first horizontal portion 204*a*, and lifts and slides his or her body into wheelchair seat 105.

ADVANTAGES

The present invention provides many advantages to persons who require the use of a wheelchair because of an injury or disability that affects the use of their legs. First, it provides an increased measure of independence by providing a device that allows wheelchair users to quickly and easily self-transfer from the wheelchair to the floor, and from the floor to the wheelchair, using only their own motive power. No attendant or powered lifting device is required. Because of the light weight and collapsible design of the present invention, it may easily be stored on the wheelchair and self-positioned for use by the wheelchair user, or alternatively, stored in areas where it would most often be needed or utilized.

The present invention also increases the safety and security of wheelchair users. In the event of an accident during which the wheelchair is upset, a wheelchair user is provided the means by which to independently regain functional use of the wheelchair. The present invention also allows a wheelchair user quick and easy access to the floor and back into the wheelchair for activities such as exercising, playing with children, engaging in leisure activities, gardening, or accessing a swimming pool.

What is claimed is:

1. A wheelchair transfer device for allowing a wheelchair user to self-transfer from a wheelchair seat to a floor comprising:

a) a pair of seat supports, each seat support including a first vertical member, a second vertical member, a horizontal member disposed between said first and second vertical members, and a transition member disposed above said horizontal member and connected between said first and second vertical members then extending horizontally beyond said vertical member;

b) an intermediate seat extending between said supports and adapted to be slidingly connected to said seat supports, whereby said wheelchair user may slide forward on said intermediate seat along said horizontal support members; and c) means for attaching said seat supports to a wheelchair.

2. The wheelchair device of claim 1 wherein said first vertical member is longer than said second vertical member.

3. The wheelchair transfer device of claim 1 wherein said attaching means comprises a bracket, said bracket including a first attaching portion adapted to attach to said wheelchair and a second attaching potion adapted to attach to said first vertical member.

4. The wheelchair transfer device of claim 3 further including a guide tube adapted to be connected to said second attaching portion and to slidingly receive said first vertical member.

5. The wheelchair transfer device of claim 1 wherein said attaching means comprises a guide tube adapted to be connected to said wheelchair.

6. The wheelchair transfer device of claim 5 wherein said guide tube is adapted to slidingly receive said first vertical member.

7. A wheelchair transfer device for allowing a wheelchair user to self-transfer from a wheelchair seat to a floor comprising:

a) a pair of seat supports, each of said seat supports including:

1) a first vertical member adapted to be connected to said wheelchair and to contact said floor;

2) a second vertical member, of lesser length than said first vertical member, said second vertical member disposed frontward of said first vertical member and in contact with said floor;

3) a horizontal member disposed between said first vertical member and said second vertical member; and 4) a transition member substantially co-planar with said horizontal member and disposed between a top portion of said first vertical member and a top portion of said second vertical member, said transition member further extending cantileveredly frontward from said second vertical member;

b) an intermediate seat extending between said seat supports, said intermediate seat comprising a flexible sling adapted to be connected to said horizontal members of said seat supports; and c) means for attaching said seat supports to said wheelchair.

8. The wheelchair transfer device of claim 7 wherein said attaching means comprises a bracket, said bracket including a first attaching portion adapted to attach to said wheelchair and a second attaching portion adapted to attach to said first vertical member.

9. The wheelchair transfer device of claim 8 further including a guide tube adapted to be connected to said second attaching portion and to slidingly receive said first vertical member.

10. A method for transferring a wheelchair user from a wheelchair to a floor comprising:

a) providing a pair of handrails disposed on either side of said wheelchair, each of said handrails located substantially at a front of said wheelchair at an elevation proximate to a seat of said wheelchair;

b) providing a pair of vertical support members for each handrail;

c) providing a means to attach one of said vertical support members of each handrail to said wheelchair;

d) providing a horizontal support member for each handrail, each of said horizontal support members disposed between said pair of vertical support members;

e) providing an intermediate seat disposed between said horizontal support members, said intermediate seat adapted to be slidingly connected to each horizontal support member;

f) locating said intermediate seat at an elevation intermediate to a seat of said wheelchair and to said floor;

g) providing an extension for each of said handrails, each of said extensions extending frontward from said wheelchair with each of said extensions being substantially coaxial with each of said horizontal members; and h) providing a sloping section to each of said handrails to transition each of said handrails from an elevation proximate to said wheelchair seat to an elevation proximate to said intermediate seat;

whereby said wheelchair user, while sitting in said wheelchair, may grasp said handrails and self-transfer from said wheelchair seat to said intermediate seat, slide forward on said intermediate seat along said horizontal support members, then grasp said extensions and self-transfer from said intermediate seat to said floor.

* * * * *